United States Patent [19]

Bessler

[11] Patent Number: 4,886,042

[45] Date of Patent: Dec. 12, 1989

[54] SIDE PANEL ASSEMBLY FOR KITCHEN RANGE

[75] Inventor: Warren F. Bessler, Schenectady, N.Y.

[73] Assignee: General Electric Company, Schenectady, N.Y.

[21] Appl. No.: 299,098

[22] Filed: Jan. 19, 1989

[51] Int. Cl.[4] ..... F24C 15/32

[52] U.S. Cl. ..... 126/21 R; 126/37 R; 126/275

[58] Field of Search ..... 126/21 A, 21 R, 19, 126/20, 273 R, 299 R; 219/400

[56] References Cited

U.S. PATENT DOCUMENTS

| | | | |
|---|---|---|---|
| 662,874 | 11/1900 | Marshall et al. | 432/207 |
| 1,298,358 | 3/1919 | Kuhn et al. | 126/275 |
| 1,466,941 | 9/1923 | Houze | 215/12.1 |
| 2,852,933 | 9/1958 | Amundson | 52/405 |
| 3,081,763 | 3/1963 | Newell, Jr. et al. | 126/21 A |
| 3,485,229 | 12/1969 | Gilliom | 126/21 A |
| 4,125,354 | 11/1978 | Andrews | 126/19 R |
| 4,241,718 | 12/1980 | Barnett | 126/21 R |
| 4,245,615 | 1/1981 | Moss | 126/273 R |
| 4,616,562 | 10/1986 | Kuechler | 126/299 R |
| 4,619,098 | 10/1986 | Taylor | 52/738 |
| 4,638,615 | 1/1987 | Taylor | 52/364 |

*Primary Examiner*—James C. Yeung

*Attorney, Agent, or Firm*—John S. Beulick; James C. Davis, Jr.; Paul R. Webb, II

[57] ABSTRACT

An improved side panel adapted for use in a kitchen range is provided which has improved thermal and structural properties. The improved construction of the side panel provides a channel member attached to an inner surface of the panel and extending from a lower rear portion of the panel and range to an upper front corner of the panel and range. The channel member provides an air passageway which concentrates a buoyancy driven convective flow of air from the lower part of the range onto the upper front corner of the panel, where a localized area of high temperatures is commonly found. A crossmember attached to the inner surface of the panel is also provided, which extends from the lower front portion of the panel to the channel member and from the channel member to the upper rear portion of the panel, the crossmember abutting the sides of the channel member, the channel member and the crossmember providing structural reinforcement to the side panel permitting use of a thinner gauge steel for the side panel.

26 Claims, 4 Drawing Sheets

SIDE PANEL ASSEMBLY FOR KITCHEN RANGE

BACKGROUND OF THE INVENTION

This invention relates to gas and electric kitchen ranges having an improved construction which reduces the temperature of the range side panels, and particularly the temperature of localized hot spots in the side panels.

Gas and electric kitchen ranges have to comply with a number of different safety codes established by Underwriters Laboratory. One of these is UL 858 which establishes a maximum side panel temperature for the range. Since kitchen ranges are usually "built in", with cabinets or other appliances closely adjacent to and often in contact with the side panels, if the side panel gets too hot, there is a danger of fire. During a self-cleaning cycle, the temperatures within the oven in the range can become quite high and can approach 900° F. This is the operating mode of the range which is most critical in terms of side panel temperature, and the range must be designed so that the side panel temperature does not exceed the allowable maximum during self-cleaning. Normally, this is accomplished by designing the range such that the oven cavity is spaced from the side panels, typically by three to four inches, and covered with a blanket of insulation, typically two to two and a half inches thick, so as to leave an air gap between the side panels and the insulation.

In current commercially available ranges, the side panel temperature during the self-cleaning cycle is the limiting design factor for the width of the oven cavity. During a self-cleaning cycle, the surface temperature of the insulation close to the front panel flange of the oven may be as high as 400° F., and the air gap helps to reduce heat transferred into the side panels by providing a limited amount of convective cooling.

In instances where the range is installed with its sides flush against kitchen cabinets, substantially the only means of heat removal is a flow of air entering the side panel air gap from the bottom of the range and exiting from under the cooktop. The air gap geometry is known to have an effect on temperatures evidenced at the side panels.

Air gaps in currently available ranges may comprise merely the space between the side panels and the range intervals, including the oven cavity insulation. In other instances, the air gap is well defined by making the entire side panel double walled, the two walls defining the air gap. The top of these air gaps open either directly into the space beneath the cook top, or into slots cut in the spillover pans or "birdbaths" disposed beneath the burners.

Although conventional range designs are capable of maintaining side panel temperatures within acceptable limits during self-cleaning, several disadvantages are present. It is common, for example, to find localized high temperature regions, or hot spots, in the side panels, where the temperature may exceed the temperature of other regions of the side panels by as much as 40° F. Typically, these hot spots are located in the upper regions of the side panels adjacent to the front of the range. Also, the necessity of spacing the oven cavity from the side panels sufficiently to maintain the side panel temperature below an acceptable maximum temperature limits the size of the oven cavity which can be used in a standard 30 inch side range.

One approach to reducing the temperature of the localized high temperature regions is found in U.S. patent application Ser. No. 166,949, filed Mar. 11, 1988, entitled "Method and Apparatus for Reducing Side Panel Hot Spots in a Kitchen Range" and assigned to the assignee of the present application. As described in that application, thermal conduction breaks at the front face of the side panel and on the inner surface of the oven door act to inhibit the conductive transfer of heat from these areas to the upper side portion of the side panel. This approach improves the temperature distribution on the side panel, however, and need continues to exist in the industry to further reduce temperatures at the side panel hot spot regions, and particularly the region at the upper front part of the panel.

It is also desirable in making kitchen range side panels to use lighter gauges (thickness) of steel, however, such lighter gauges are generally susceptible to denting and deformation without further means of reinforcement.

It is therefore an important object of the present invention to provide a side panel assembly for a kitchen range having enhanced thermal performance in that hot spot temperature differentials are reduced.

It is a further object of the present invention to provide a kitchen range side panel assembly which offers improved structural rigidity combined with improved thermal performance in eliminating elevated temperature regions.

SUMMARY OF THE INVENTION

The above and other objects of the present invention and the attendant advantages are accomplished by providing a side panel assembly for a kitchen range which has as a box-like convective channel secured to an interior of the side panel which extends between a lower rear portion of the panel and an upper front portion of the panel. The channel is open at both of these extremities such that cooler air may be transported to the upper front corner of the side panel, which is generally the hottest region of the side panel. The channel is in intimate contact with the side panel, particularly at its upper extent, thereby also providing a thermal conductive path to dissipate heat away from the upper front corner of the panel.

An additional panel support cross member may be provided to further enhance the structural rigidity of the side panel, the cross member extending from a lower front corner of the panel to the convective channel, and continuing from the convective channel to an upper rear corner, the convective channel and the panel support member forming an approximately "X" shaped reinforcement for the side panel. The use of such a reinforcement permits the use of a side panel of thinner gauge steel than that used previously in conventional ovens.

In a further aspect of the present invention, a kitchen range is provided having more even temperatures at the side panels, enabling modifications, such as the size of the oven cavity, to be incorporated into the kitchen range design.

BRIEF DESCRIPTION OF THE DRAWINGS

These and other features of the present invention and the attendant advantages will be readily apparent to those having ordinary skill in the art and the invention will be more easily understood from the following detailed description of the preset invention taken in conjunction with the accompanying drawings, wherein like reference characters represent like parts throughout the several views, and wherein.

DETAILED DESCRIPTION OF THE INVENTION

Figure 1:
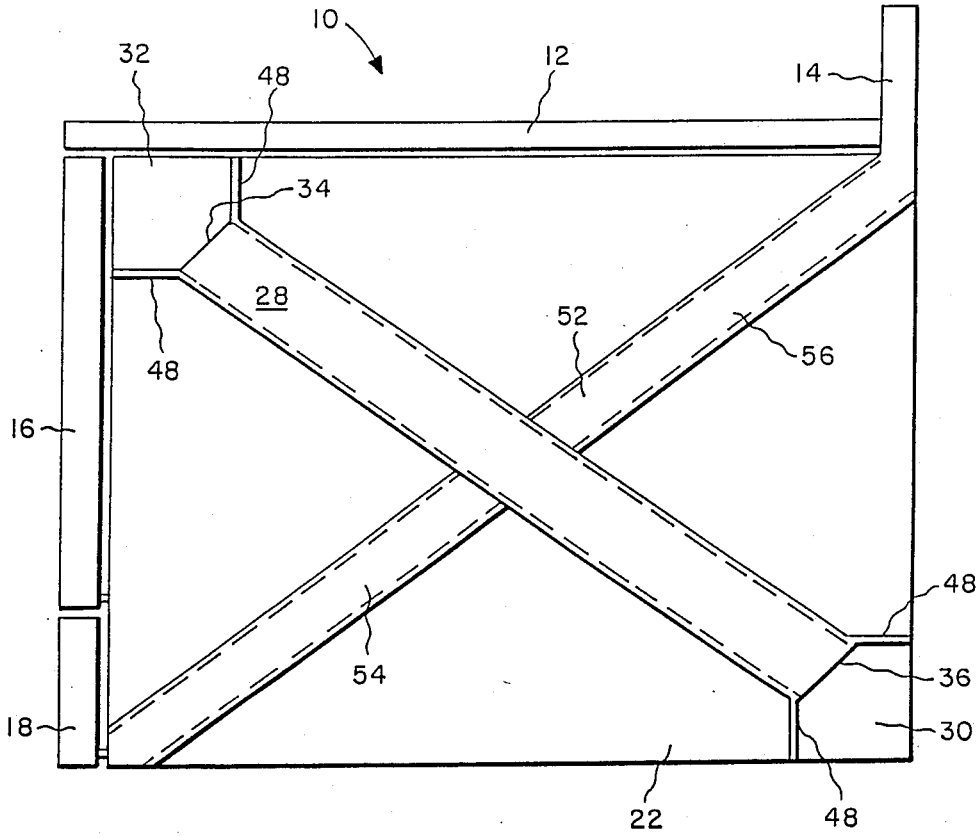
FIG. 1 depicts a side elevation view of the side panel of a kitchen range, wherein various range components are depicted in schematic form.

Referring initially to FIG. 1, a schematic representation of a kitchen range 10 employing a side panel according to a preferred embodiment of the present invention is depicted. FIGS. 2–6 present further views of this embodiment, and will be referred to where specific details are best shown in those figures. Shown in substantially block form in FIG. 1, are cooktop 12, backsplash 14, oven door 16, and lower drawer 18. The actual kitchen range would also be equipped with support feet and burner and oven controls, however, details of such elements have been omitted as they are not essential to an understanding of the present invention. Oven door 16 may be pivotably mounted in a conventional manner on the front of the range, and the illustrated kitchen range 10 may be either a gas or electric range of the type normally used in a household.

Side panel 22 of the present invention is shown in FIG. 1 as through it were being viewed from the interior of the range 10. A side panel 22 is provided at each side of the range, as can best be seen in FIGS. 3 and 6. Side panel 22 is generally planar along its major height and depth dimensions and has a front face 24 and an inner flange 26 bent rearward to form a stiffening channel 25. Faces 24 and flange 26 are provided as interfaces to other range components, also shown in FIGS. 3 and 6, although these portions of the panel need not be discussed in detail in order to acquire a full understanding of the improvements provided by the present invention. Similar stiffening channels are formed at the rear of each panel.

Figure 4:
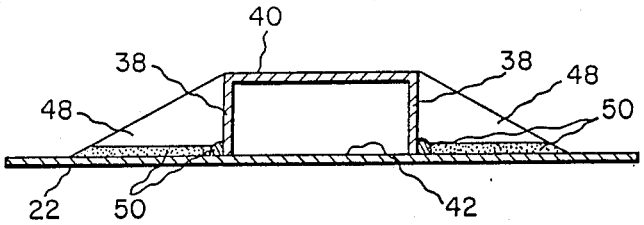
FIG. 4 is a cross-sectional view of the convective channel taken along line 4—4 of FIG. 2.
Figure 5:
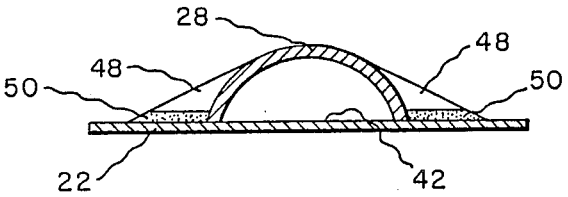
FIG. 5 is a cross-sectional view of an alternative embodiment of the convective channel similar to the view of FIG. 4.

Side panel 22 is provided with a channel member 28 extending from a location near a bottom rear corner 30 of the range 10 to an upper front corner 32 of the range. As depicted (see especially FIGS. 2 and 4), the channel is preferably of a squared "C" shape in cross-section forming a rectangular duct with side panel 22 and is open at both its upper and lower ends 34 and 36 respectively. The substantially C-shaped channel has two side members 38 which protrude perpendicularly from an interior surface of side panel 22. Channel 28 in this embodiment has a planar web element 40 attached to and spanning the space between legs 38, the web being spaced from and parallel to the inner surface 42 of range side wall 22. The channel 28 may advantageously be an integral sheet metal member which is formed into the C-shaped channel by known sheet metal bending and forming means. The channel may optionally be made of other cross-section shapes, for example, in an arcuate or semi-circular shape, as depicted in FIG. 5.

Channel member 28 opens into the air gap 44 (FIG. 6) of the range at an upper front region 32 and a lower rear region 30 (FIG. 1) of the range at a distance on the order of several inches from the respective corners 44 and 46 of the side panel 22. The term air gap is used in the industry to identify the space between the side panel 22 and the side boundaries of the oven 100, including any insulation (not shown) surrounding the oven. At these areas, channel member 28 flares outwardly to form legs 48, which diverge out to adjacent edges of the side panel. The legs 48 are attached to the side panel with a strong bond, such as a weld, solder, or braze. Such bonds are desirable to ensure good thermal contact and to provide structural support. The attachments are depicted in FIGS. 4 and 5, wherein weld beads 50 are shown at the joints where legs 48 and the end of channel 28 meet side panel 22. At these ends of channel member 28, the web portion 40 (FIG. 4) of the channel is omitted to permit air to flow freely into and out of the channel.

A convective air flow path is thus provided from the lower rear corner of the range, where cooler air commonly enters the interior of the range, to the upper front corner of the panel and range, where the hottest side panel temperatures are encountered. An air flow transporting the cool air upwardly through the channel member 28 to cool the upper front corner is effected and driven by the buoyancy effects of the air, brought about by differences in density, wherein more dense cooler air pushes less dense warmer air upwardly. The hottest air will escape through any available openings in the cooktop, and cooler air will continue to push air upwardly, moving air across the upper front corner of the side panel 22, and cooling the area by convection.

The attachment of channel member 28 near the upper front corner of the side panel 22 further aids in reducing the temperature of the hot spot by providing a conductive flow path which is capable of taking heat away from the upper front corner area of the side panel and transferring or conducting the heat along the cooler channel member 28. Because, in the depicted preferred embodiment, channel member 28 is attached to side panel 22 by weld beads 50, a relatively large contact area and conductive mass are provided to assist in the conduction of heat away from the hot spot.

Figure 2:
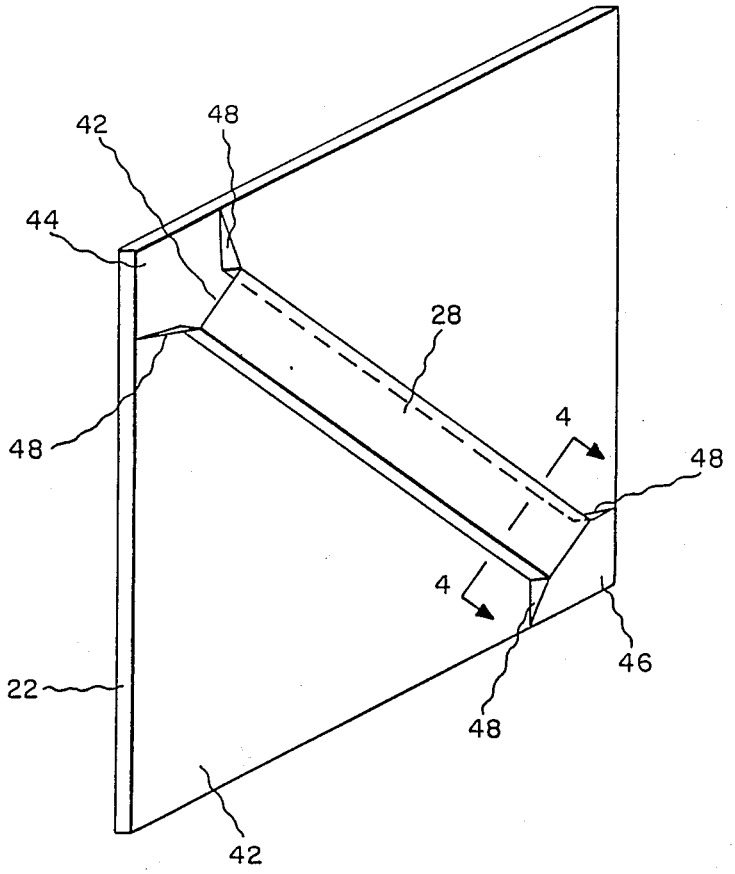
FIG. 2 is a perspective view of the flat portion of range side panel having the convective air channel secured thereto.
Figure 3:
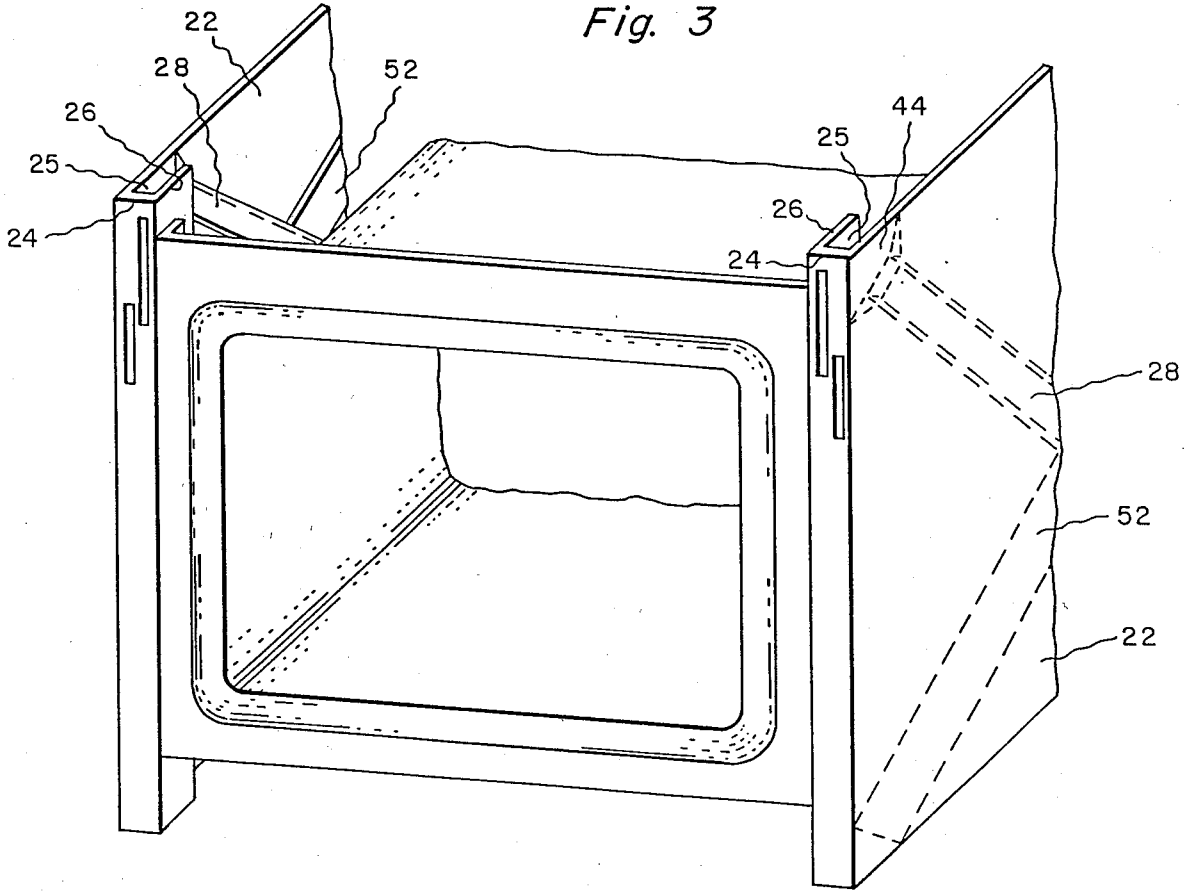
FIG. 3 is a fragmentary perspective view of a kitchen range employing side panels in accordance with the present invention.
Figure 6:
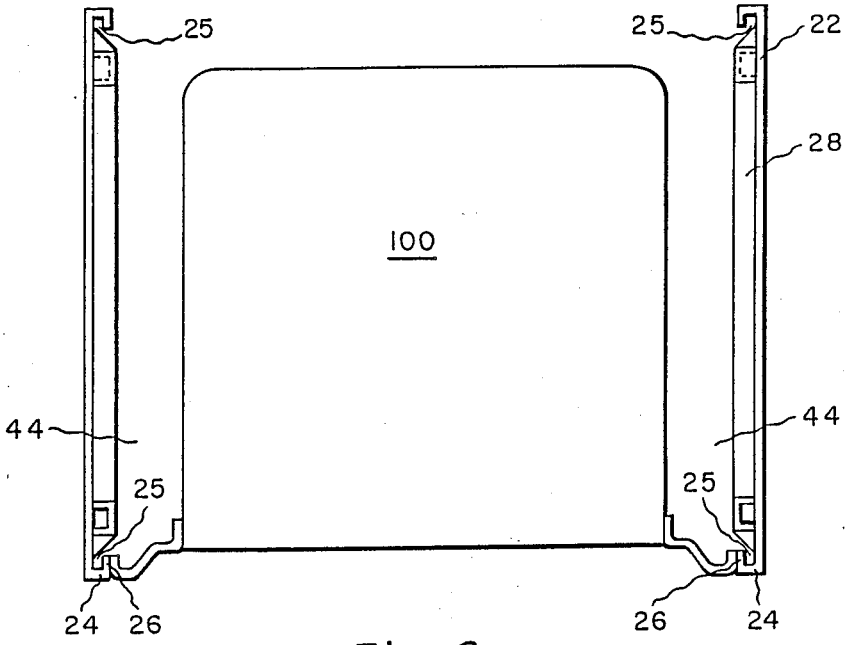
FIG. 6 is a top plan view of two side panels according to a preferred embodiment of the present invention shown in position with a schematic representation of an oven cavity.

The range 10 may also advantageously be provided with a second cross member 52, shown in FIGS. 1 and 3, and omitted from FIGS. 2 and 6 to more clearly show channel 28, which extends diagonally from a lower front corner of the panel 22 to an upper rear corner of the panel. Cross member 52 is not a continuous member, as can best be seen in FIG. 1, as a lower segment 54 and an upper segment 56 forming the cross member are interrupted at an approximate midpoint by channel member 28. The lower and upper segments are preferably attached to channel member 28 in an abutting manner. The segments will preferably have a C-shaped cross-section similar to that of the channel member 28, and may have flared sections at the ends adjacent their associated corners of the side panel 22, or may alternatively retain the same channel shape along the entire longitudinal extent.

Cross member 52 is provided primarily for structural reinforcement of the side panel, and is not intended to contribute significantly to the thermal performance of the side panel 22. The structural rigidity provided to the side panel by channel member 28 and cross member 52 permits the use of a thinner gauge steel for the side panel. An appropriate thickness of a side panel for a production electric range employing the channel member and cross member may be on the order of 0.032 inches, and may advantageously be less than that thickness. The channel member and cross member serve to resist denting of the side panel as well as providing additional support at the side panel for the leveling of the feet and cooktop of the range.

While a preferred embodiment of the present invention has been shown and described, it may become readily apparent to those skilled in the art that changes can be made to the disclosed embodiment without departing from the principles and spirit of the invention. Accordingly, the scope of the present invention is to be determined by reference to the appended claims.

What is claimed is:

1. A kitchen range side panel assembly adapted to enclose a side portion of a kitchen range, said side panel assembly comprising:

a substantially rectangular, planar panel having an outer surface and an inner surface, and air transporting means attached to said inner surface, said air transporting means comprising a channel member for transporting a flow of cooling air from a lower rear portion of said panel at an interior of said range to an upper front portion of said panel at said interior of said range.

2. A kitchen range side panel assembly as defined in claim 1, wherein said channel member has a passageway therethrough, said channel member having a first opening at said lower rear portion and a second opening at said upper front portion of said panel, and said flow of cooling air is buoyancy driven convective flow.

3. A kitchen range side panel assembly as defined in claim 2, wherein said channel member is disposed diagonally along said panel and said first and said second openings are located at a distance on the order of several inches inward from a lower and an upper corner of said panel.

4. A kitchen range side panel assembly as defined in claim 3, wherein said channel member further comprises a first pair of flared support legs extending from said first opening to a pair of adjacent edges of said panel, and a second pair of flared support legs extending from said second opening to a pair of adjacent edges of said panel.

5. A kitchen range side panel assembly as defined in claim 4, wherein said channel member is attached to said inner surface of said panel by a thermally conductive bonding of said first and second pairs of support legs to said panel.

6. A kitchen range side panel assembly as defined in claim 5, wherein said bonding comprises welding beads attaching said legs to said rectangular panel.

7. A kitchen range side panel assembly as defined in claim 2 further comprising a cross member attached to said side panel, said cross member having a lower segment extending from a lower front portion of said side panel to said channel member, and an upper segment extending from said channel member to an upper rear portion of said side panel.

8. A kitchen range side panel assembly as defined in claim 7, wherein said rectangular panel is constructed of a thin gauge steel, a thickness of said panel being on the order of 0.032 inches.

9. A kitchen range side panel assembly as defined in claim 2, wherein said channel member comprises a pair of spaced side members extending inwardly from said inner surface of said rectangular panel substantially perpendicularly to said inner surface, and a web portion integral with and spanning the pair of spaced side members, said web portion being spaced away from said inner surface of said panel at a predetermined distance.

10. A kitchen range side panel assembly as defined in claim 2, wherein said channel member has an arcuate cross-sectional shape.

11. In a kitchen range having a first and a second side panel, the first and second side panels being disposed at a predetermined distance from a first and second sides of an oven contained in an interior of said range, the improvement comprising:

a first means for transporting a flow of air from a lower rear portion of said first side panel to an upper front portion of said first side panel, said first transporting means comprising a first channel member; and a second means for transporting a flow of air from a lower rear portion of said side panel to an upper front portion of said second side panel, said second transporting means comprising a second channel member wherein said flows of air being transported by said first and transporting means are buoyancy driven convective air flows.

12. A kitchen range as defined in claim 11, wherein said first channel member is attached to an inner surface of said first side panel, said second channel member is attached to an inner surface of said second side panel, said first and second channel members extending diagonally along said associated inner surfaces from said lower rear portions of said side panels to said upper front portions of said panels, said channel members forming passageways with said inner surfaces, wherein said passageways are adapted to contain said air flows.

13. A kitchen range as defined in claim 12, wherein each of said channels has an opening at each end thereof to an interior air space of said range, said openings being spaced at a distance on the order of several inches from a lower rear corner and an upper front corner of said associated side panel, and each end of each of said channels has a pair of flared support legs extending from said opening to an adjacent edge of said side panel.

14. A kitchen range as defined in claim 13, wherein each of said channels is bonded to said inner surface of said associated side panels at said flared support legs.

15. A kitchen range as defined in claim 14, wherein the improvement further comprises a first cross member attached to said first side panel and a second cross member attached to said second side panel, each of said cross members having a lower segment extending from a lower front portion of an associated side panel to said channel member, and an upper segment extending from said channel member to an upper rear portion of said associated side panel.

16. A kitchen range as defined in claim 11, wherein said first and said second side panel are constructed of a thin gauge steel not greater than about 0.032 inches in thickness.

17. A kitchen range side panel assembly comprising:

a substantially rectangular planar panel having an outer surface and an inner surface, and a channel member attached to said inner surface of said panel and extending diagonally across said inner surface from a lower rear portion of said panel to an upper front portion of said panel, said channel having a lower opening and an upper opening in communication with a kitchen range air space, said channel forming an air passageway between said lower rear portion and said upper front portion of said panel adapted to permit air to flow through an entire longitudinal extent thereof.

18. A kitchen range side panel assembly as defined in claim 17, further comprising a cross member attached to said inner surface of said panel, said cross member having a lower segment extending diagonally across said inner surface from a lower front portion of said panel to said channel member and an upper segment extending diagonally from said channel member to an upper rear portion of said side panel, said lower and upper segments of said cross member being disposed in substantially abutting contact with said channel member at an approximate midpoint area of said channel member.

19. A kitchen range side panel assembly as defined in claim 18, wherein said channel member has a substantially squared-off C-shape in cross-section and said upper opening and said lower opening of said channel member form a substantially rectangular opening with said side panel comprising an outer wall of said rectangular opening.

20. A kitchen range side panel assembly as defined in claim 18, wherein said cross member has a cross-sectional shape substantially identical to the cross-sectional shape of said channel member.

21. A kitchen range side panel assembly as defined in claim 17 wherein said lower opening and said upper opening of said channel are spaced from a lower and an upper corner of said rectangular panel at a predetermined distance.

22. A kitchen range side panel assembly as defined in claim 2 wherein said predetermined distance is on the order of several inches.

23. A kitchen range side panel assembly as defined in claim 22 wherein said upper opening of said channel has a pair of support legs extending divergently outwardly from said opening to a pair of adjacent edges of said rectangular panel, and said lower opening of said channel has a pair of support legs extending divergently outwardly from said opening to a pair of adjacent edges of said rectangular panel.

24. A kitchen range side panel assembly as defined in claim 23, wherein said channel member is attached to said rectangular panel at said pairs of support legs, each of said support legs being welded to said rectangular panel.

25. A kitchen range side panel assembly as defined in claim 23, wherein said channel member is attached to said rectangular panel at said pairs of support legs, each of said support legs being brazed to said rectangular panel.

26. A kitchen range side panel assembly as defined in claim 23, wherein said channel member is attached to said rectangular panel at said pairs of support legs, each of said support legs being soldered to said rectangular panel.

* * * * *